United States Patent [19]

Frost

[11] 4,068,843

[45] Jan. 17, 1978

[54] HEAVY-DUTY SWIVEL ARM-WRESTLER AND EXERCISER

[76] Inventor: Donald L. Frost, 322 N. Marlyn Ave., Baltimore, Md. 21221

[21] Appl. No.: 699,863

[22] Filed: June 25, 1976

[51] Int. Cl.[2] ..... A63B 21/06

[52] U.S. Cl. ..... 272/118

[58] Field of Search ..... 272/118, 128, 136, 142, 272/117; 108/91; 211/59; 124/24 R, 23 R

[56] References Cited

U.S. PATENT DOCUMENTS

| | | | |
|---|---|---|---|
| 434,439 | 8/1890 | Forest | 272/118 |
| 911,925 | 2/1909 | Zeno | 272/142 X |
| 2,782,033 | 2/1957 | Ugartechea | 272/136 |
| 3,294,399 | 12/1966 | Cugliari | 272/117 |
| 3,517,657 | 6/1970 | Alban | 124/24 R X |
| 3,640,527 | 2/1972 | Proctor | 272/118 |
| 3,708,166 | 1/1973 | Annas | 272/118 X |

FOREIGN PATENT DOCUMENTS

| | | | |
|---|---|---|---|
| 169,180 | 10/1959 | Sweden | 108/91 |

*Primary Examiner*—Harland S. Skogquist
*Assistant Examiner*—William R. Browne
*Attorney, Agent, or Firm*—John F. McClellan, Sr.

[57] ABSTRACT

A table-mounted pivotally hinged arm simulates an arm-wrestling opponent's arm, resistance being adjustably provided by a guided counterweight beneath the table connected by a cable over a pulley above one end of the table to the free end of the hinged arm; a protrusive guard on the hinged arm prevents the cable from riding across the hand of a user when pressing over center; the base of the table has a safety extension preventing accidental tip; a gripping post and a user-height compensator are also provided; quick set-up and knock-down attachments make the invention easily portable and off-the-shelf materials used extensively, including standard bar bell weights, keep the cost moderate.

13 Claims, 5 Drawing Figures

HEAVY-DUTY SWIVEL ARM-WRESTLER AND EXERCISER

This invention relates generally to competitive-sports equipment and specifically to an exerciser-trainer for the sport of arm wrestling.

Principal objects of the invention are to provide an effective exerciser for arm wrestling which also trains in the sport.

Further objects are to provide a device as described which closely simulates the mechanics of arm wrestling, which is adjustable to vary resistance to suit the needs of users as they progress in training, which helps protect the user from injury, which provides user-height adjustment, which sets up for use and knocks down for storage or shipping quickly and easily, which is economical to purchase and use, and which is attractive in appearance and reliable in operation.

In brief summary given for cursive description only, the invention includes a table, an arm having a first end pivotally hinged to the table and a second end biased upwardly toward one end of the table by a counterweight through a cable, and means preventing the cable from bearing on the user's hand during operation of the device.

The above and other objects and advantages of the invention will become more readily apparent on examination of the following description, including the drawings, in which like reference numerals refer to like parts:

Figure 1:
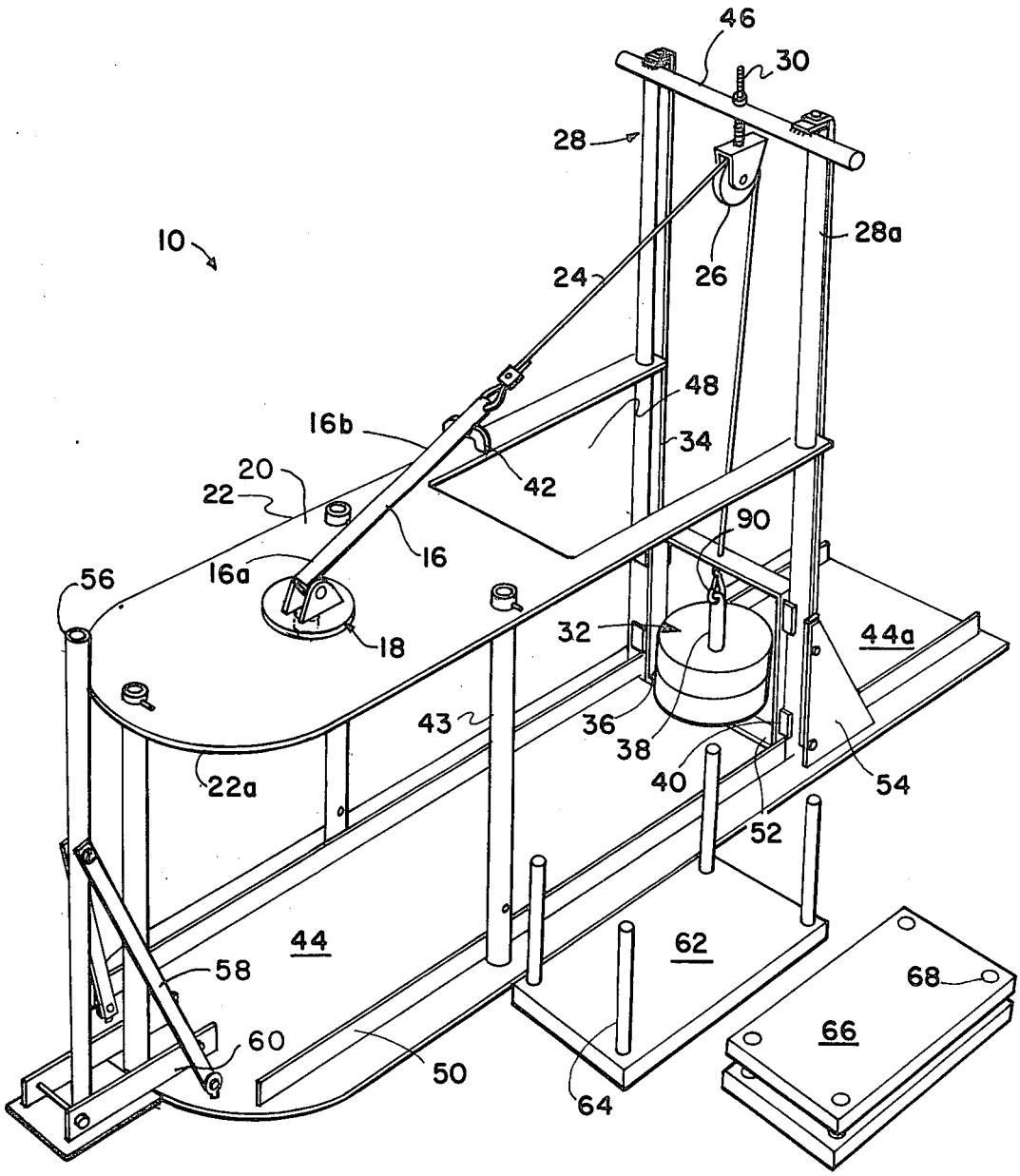
FIG. 1 is an isometric view.

FIG. 1 shows the invention 10 embodied in assembly in a circular-section tubular arm 16 having a length somewhat greater than the nominal length of a human forearm. One end 16*a* of the arm has a pivotal-hinge assembly 18 movably securing it to the top surface 20 of a table 22. The other or upper end 16*b* of the arm has attachment to a cable 24 leading upwardly and rearwardly over a pulley 26 secured on a stand 28 by an adjustment screw 30 above an end of the table and leading downwardly from the pulley to a counterweight assembly 32 which employs standard perforate barbell weights, at which point the cable has detachable securance 90. The adjustment screw raises or lowers the pulley as desired so that the user can work out his individual "sticking points" in his arm wrestling technique. Guides 34 prevent horizontal motion of the counterweight assembly as it rises and falls during operation of the exerciser/trainer. The assembly includes a rectangular counterweight frame 36 with centerpost 38 attached to the cable, and guiding ears 40.

The upper end of the arm also has a knuckle guard in the form of a transverse curved-end protrusion 42 located beneath the arm in the non-operative position or relaxed position shown. The cable is prevented by this guard from riding across the hand of the user when the arm is swung-over in use, and by the curves on the ends from slipping off the guard.

The table has a rounded front-end 22*a* to provide multiple positions for users to occupy to adjust to their individual styles and preferences while exercising, to develop selective strengths through changing lateral angles of attack. The table also has a tubular leg 43 at the rounded end and at each side connecting the table top with the base 44. The counterweight stand, a pair of parallel uprights 28*a* with a crossbar 46 at the top serves as rear legs of the table, which has an opening 48 dividing the rear of the table, permitting the counterweight assembly to be seen in use by a user.

The base is similar in shape to the top, and has a pair of parallel-spaced upright flanges 50 running from front-to-back connecting the legs and stand on the inboard side. A transverse flange 52 similarly connects the stand vertical members at the bottom, and gussets 54 brace them. The base has a rearward flange-supported protrusion 44*a* beyond the stand, for stability. A gripping post 56 with diagonal braces 58 and a post base with upright flanges 60 attaches at the front of the base; the post protrudes above the table top. The braces diverge downward and have detachable eyelet connection with the base.

To adjust the height of users, equalizing opportunity for shorter arm-wrestlers, a platform 62 is provided, consisting of a four-legged table with legs 64 up, and shim plates 66 with holes 68 fitting the legs when mounted on the platform, adjusting the height to any desired degree.

Figure 2:
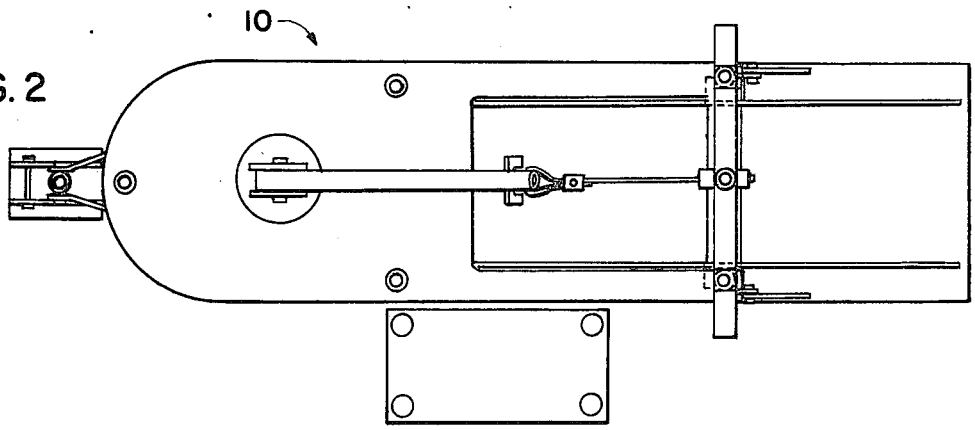
FIG. 2 is a top plan view.

FIG. 2 shows a top plan view of the apparatus.

Figure 3:
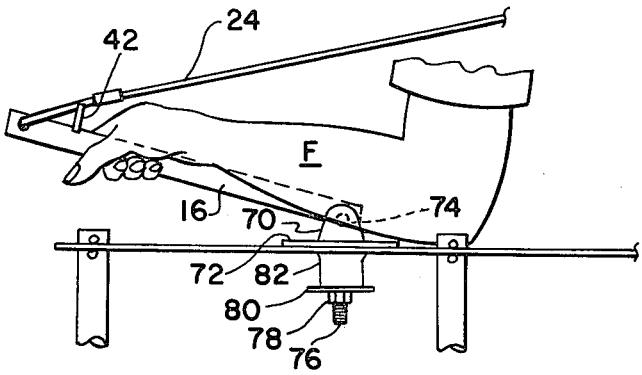
FIG. 3 is an elevational detail.

FIG. 3 details the arm 16 as thrown over by the forearm F of a user having elbow resting on table and hand grasping the arm below the knuckle-guard 42 which safely bridges the cable 24 past the user's hand.

It can be seen that the arm offers a uniform grip at all places below the guard, but that importantly, the arm cannot twist about the long axis and slip from the hand of a user. The pivotal hinge permits the arm to swing to all directions for best simulating resistance by an opponent, subject to this safety limitation. The hinge has a clevis 70 having an integral circular broad bearing plate 72 and securing by a pin 74 through the arm 16 which lies in the fork of the clevis. The circular plate permits padding the table top. A pivot stud 76 extends down from the throat of the clevis through the table and secures under adjustable tension by a nut 78 and wide-bearing washer 80 which bears on the end of a welded tubular reinforcement and access extension 82 below the table.

Figure 4:
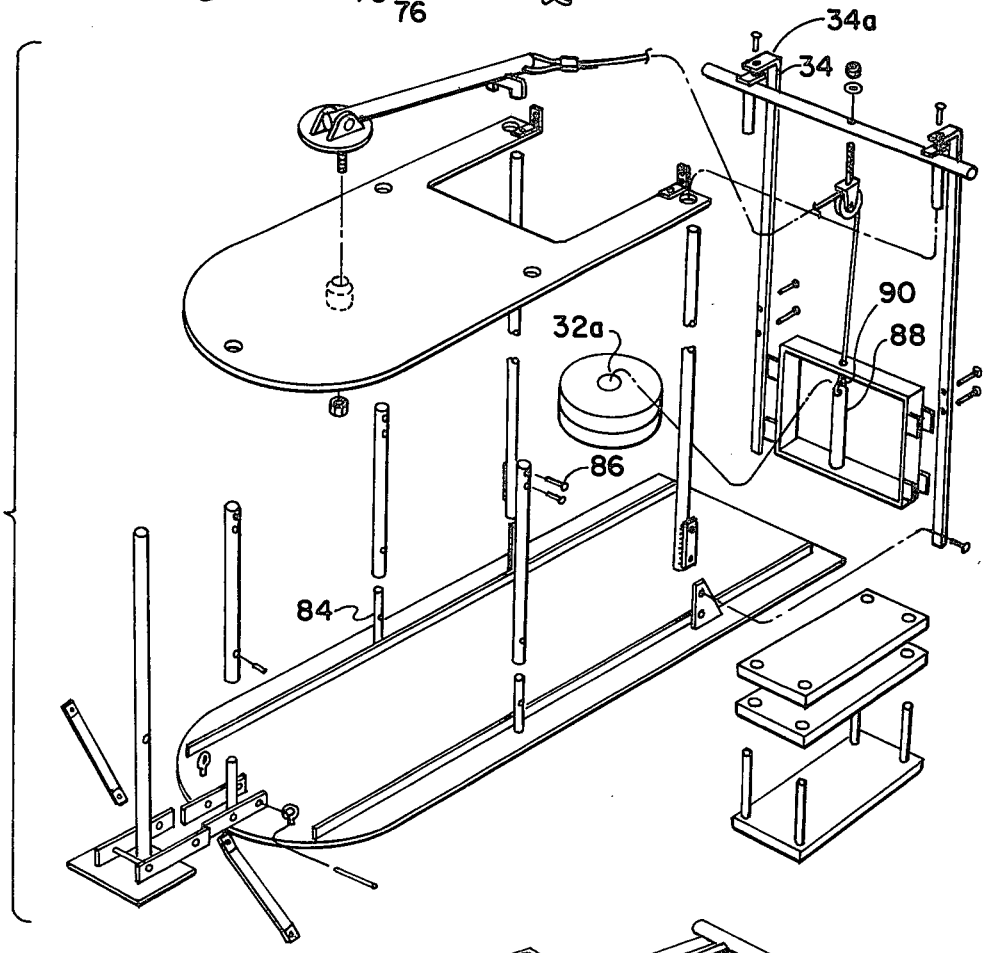
FIG. 4 is an exploded assembly view.

FIG. 4 shows the quick set-up, quick knockdown provisions of the invention. Except for the permanently welded flanges and gussets on the base and except for posts 84 which extend up from the base and slip inside the legs on assembly, the invention generally bolts and screws together.

The top of the table secures to the legs by means of a pair of pins 86 passing through the upper end of each leg, one below and one above the top. The guides 34 attach inside the stand of the counterweight by respective ears 34*a* engaging the crosspiece. The counterweight holder frame is an all-welded assembly. Counterweights 32*a* may be standard and slip on and off the top of the post 88 when the wire cable is disconnected by a snap or other quick-detach cable fitting 90.

Figure 5:
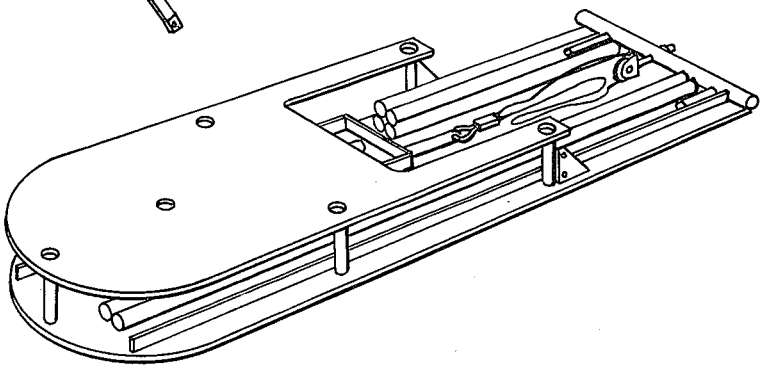
FIG. 5 is an isometric view.

FIG. 5 shows the unit completely knocked-down for shipment or for storage. Setting-up again from this position can be done by one person in a matter of minutes.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by U.S. Letters Patent is:

1. Arm wrestling practice apparatus comprising: an arm having first and second ends, a table having first and second portions, means hindgedly connecting the first end of the arm to the table and for rotatably mounting the first end of the arm to permit rotation of the arm in a plane substantially parallel to the plane of the table, and means biasing the second end of the arm in a direction relative to the table providing resistance to said pressing over of the arm.

2. Practice apparatus as recited in claim 1, the biasing means including a cable, means attaching the cable to the second end of the arm and means drawing the cable and second end of the arm to an upward angle in the direction of the first portion of the table.

3. Practice apparatus as recited in claim 2, the arm having a portion for gripping proximate the second end of the arm, and a transverse protrusion proximate the gripping portion in position for fending the cable away from the gripping portion when the arm is pressed over during practice.

4. Practice apparatus as recited in claim 3, the means drawing the cable comprising a stand above the end of the table in spaced relation with the arm, a pulley having support above the end of the first portion of the table on the stand, the cable passing over the pulley, at least one counterweight, and means detachably affixing the counterweight to the pulley.

5. Practice apparatus as recited in claim 4, the stand including a pair of parallel uprights with a crossbar at the top comprising the pulley support, the means detachably affixing the counterweight to the pulley including a frame around the at least one counterweight and having guide arrangement with the stand comprising part of the frame laterally engaging the pair of parallel uprights, a post centrally in the frame providing for holding a plurality of counterweights, said at least one counterweight have a central perforation for fitting over the post, and the cable having attachment to the post.

6. Practice apparatus as recited in claim 5, the table having an aperture in the first portion over the counterweight for viewing the counterweight while practicing arm wrestling, and the table second portion being rounded.

7. Practice apparatus as recited in claim 5, the table having a plurality of legs, a base below the legs and extending beyond the stand longitudinally, means detachably affixing the legs to the table and base including a plurality of fixed upright members engaging respective legs, and a plurality of pins passing transversely through the legs.

8. Practice apparatus as recited in claim 4, the pulley having vertically adjustable screw-support by the stand for thereby permitting a user to work out the user's "sticking points" in his arm wrestling technique.

9. Practice apparatus as recited in claim 1, the means pivotally hinging the arm including a clevis receiving the arm, means fixing the arm in the clevis, a shank protruding downward from the clevis, and means pivotally securing the shank to the table.

10. Practice apparatus as recited in claim 9, the means pivotally securing including a circular plate located below the clevis.

11. Practice apparatus as recited in claim 1, a gripping post, and means detachably securing the gripping post at the second portion of the table.

12. Practice apparatus as recited in claim 11, the gripping post having a detachable divergent-downward brace on each side thereof, each brace having eyelet connection with the base.

13. Practice apparatus as recited in claim 1, and means for adapting the apparatus to the height of a user comprising an inverted table platform with legs, and at least one shim plate having apertures therein for receiving said legs with said shim plate mounted on the platform.

* * * * *

UNITED STATES PATENT AND TRADEMARK OFFICE

CERTIFICATE OF CORRECTION

PATENT NO. : 4068843
DATED : January 17, 1978
INVENTOR(S) : DONALD L. FROST

It is certified that error appears in the above-identified patent and that said Letters Patent are hereby corrected as shown below:

Claim 1, line 3, delete "hindgedly" and insert -- hingedly --;

line 8, delete "said";

Claim 9, line 2, delete "pivotally hinging" and insert -- hingedly connecting --.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*